US007485073B2

(12) United States Patent
Chang

(10) Patent No.: US 7,485,073 B2
(45) Date of Patent: Feb. 3, 2009

(54) MUSCLE EXERCISER

(76) Inventor: Horng-Jiun Chang, P.O. Box 44-2049, Taipei (TW) 10668

( * ) Notice: Subject to any disclaimer, the term of this patent is extended or adjusted under 35 U.S.C. 154(b) by 371 days.

(21) Appl. No.: 11/497,392

(22) Filed: Aug. 2, 2006

(65) Prior Publication Data

US 2008/0032866 A1 Feb. 7, 2008

(51) Int. Cl.
*A63B 21/00* (2006.01)

(52) U.S. Cl. ..... 482/70; 482/51; 482/66

(58) Field of Classification Search ..... 482/51, 482/54, 57, 66–71, 74, 79, 80; 434/247; 119/700

See application file for complete search history.

(56) References Cited

U.S. PATENT DOCUMENTS

| | | | | |
|---|---|---|---|---|
| 7,179,205 | B2 * | 2/2007 | Schmidt | 482/70 |
| 7,322,904 | B2 * | 1/2008 | Takizawa et al. | 482/8 |
| 2007/0298935 | A1 * | 12/2007 | Badarneh et al. | 482/52 |

* cited by examiner

*Primary Examiner*—Glenn Richman
(74) *Attorney, Agent, or Firm*—C. G. Mersereau; Nikolai & Mersereau, P.A.

(57) ABSTRACT

A muscle exerciser having a first pulley mounted on a motor shaft of a motor, a second pulley mounted on a pulley shaft and connected to the first pulley through a transmission belt, two transmission wheels respectively connected two ends of the pulley shaft, two transmission links connected to the wheels, and two sliding seats connected to the links. The transmission wheels are respectively connected to the transmission links oppositely such that the two sliding seats are moved close to or away from each other along sliding tracks when the wheels are rotated. Thus, the quick sliding of the sliders strengthens the muscle of the hands/feet placed on the sliding seats.

3 Claims, 5 Drawing Sheets

MUSCLE EXERCISER

BACKGROUND OF THE INVENTION (1) Field of the Invention

The invention relates to a muscle exerciser having a transmission mechanism for moving two opposite sliders transversely in leftward and rightward directions to shake hands, feet or other parts of a user and thus to strengthen the muscle of the user.

(2) Description of the Prior Art

The modern human beings may have redundant fat stored in the body due to the busy working and abnormal diet. They cannot work hard to improve the fat constitution by exercise efficiently as the diet is not particularly restricted. Consequently, it is more difficult to eliminate the fat stored in their backsides of the arms and the legs by the outdoor exercise.

Many manufacturers have developed various fat-reducing machines or devices for the consumers to choose due to the increased demands of the human beings in the aspect of beauty consideration and the health protection. Among the devices, a shaking device can shake the legs to achieve the object of burning the fat and strengthening the muscle. However, the legs are shaken back and forth and leftward and rightward, which cannot meet the requirement of human factor engineering. So, the muscle may be hurt due to the incapability of accommodation.

Also, a typical exerciser for guiding the hands and legs to shake can simultaneously exercise the muscle of the hands and feet. However, the exerciser is large in size, expensive and thus not ideal because the exerciser is configured to make the user stand thereon.

Thus, the prior art shaking device is not ideal because it cannot easily strengthen the muscle in an efficient manner due to the structural design, or even it may hurt the muscle of the user due to the incapability of accommodation.

SUMMARY OF THE INVENTION

It is therefore an object of the invention to provide a muscle exerciser having sliders capable of repeatedly sliding inwards and outwards in conjunction with the inertial motion of the hands/feet of the user to easily burn the fat and strengthen the muscle.

Another object of the invention is to provide a multi-functional device having sliders each composed of two blocks respectively adapted to the sole placement and the palm placement.

Still another object of the invention is to provide a muscle exerciser having sliders each having a surface covered with a soft material for the sake of comfortableness. Thus, it is possible to prevent the hands and feet from impacting on the exerciser and thus from being hurt. Furthermore, the sliders, which can slide repeatedly, can strengthen the muscle and prevent the expansion of the muscle, which causes the significant textures. So, the exerciser is suitable for most of the female consumers.

The invention achieves the above-identified object by providing a muscle exerciser having two wheels, which are connected to a pulley and have opposite designs. Thus, sliding seats can slide back and forth repeatedly and oppositely through the connections of transmission links, such that the effect of strengthening the muscle in a human factor engineering manner can be achieved.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

The structure, composition, technological means and effect of the invention will be described with reference to the accompanying drawings.

Figure 1:
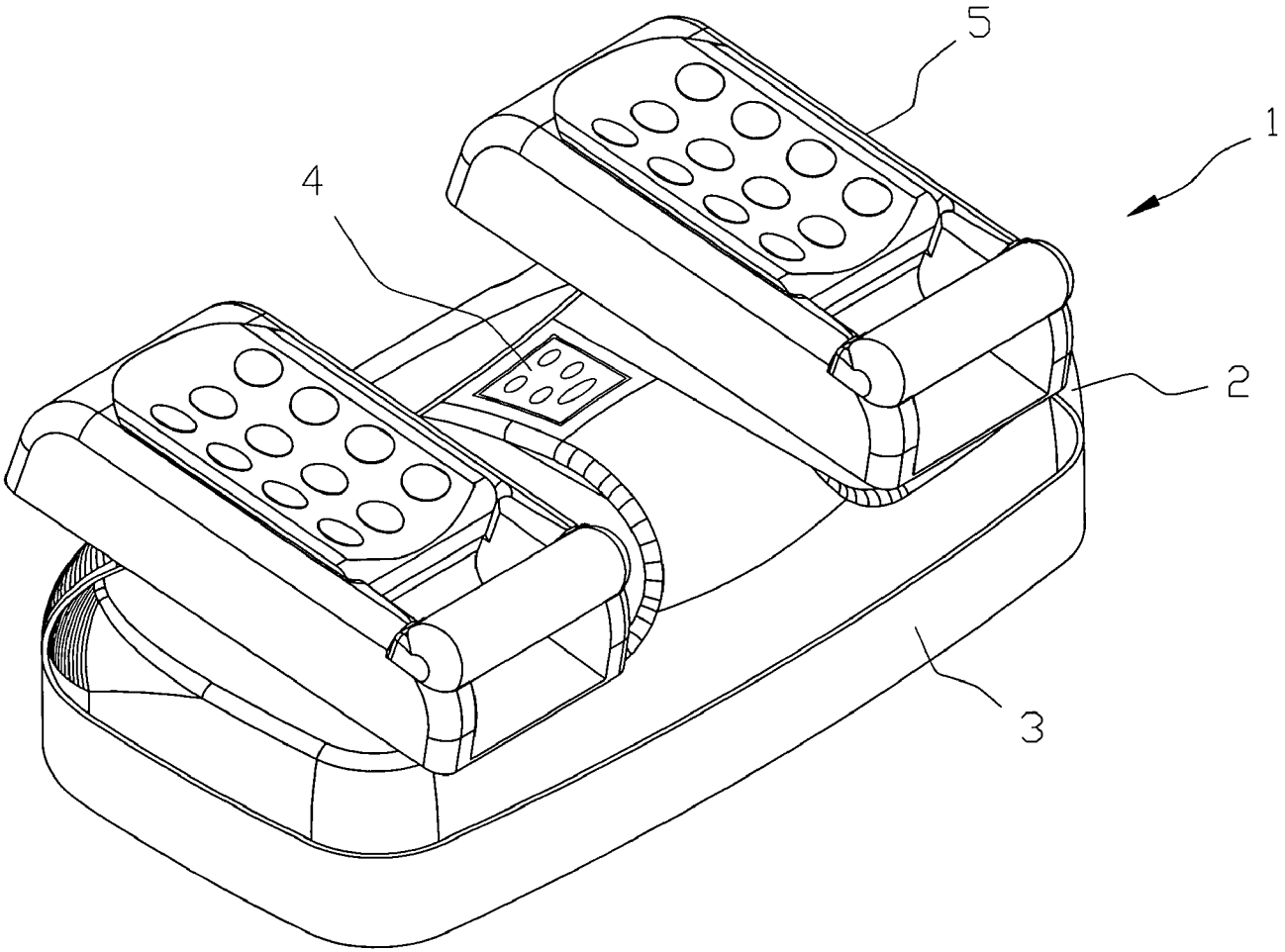
FIG. 1 is a pictorial view showing a hand/foot muscle exerciser according to the invention.

FIG. 1 is a pictorial view showing a muscle exerciser according to the invention. As shown in FIG. 1, the external structure of the hand/foot muscle exerciser (1) of the invention is mainly composed of an upper cover (2) and a base (3) combined therewith. A controller (4) is disposed at a protruding middle portion of the upper cover (2) and controls the speed of the exerciser (1). Two sliders (5), on which hands and feet can be placed, are disposed at two sides of the cover.

Figure 2:
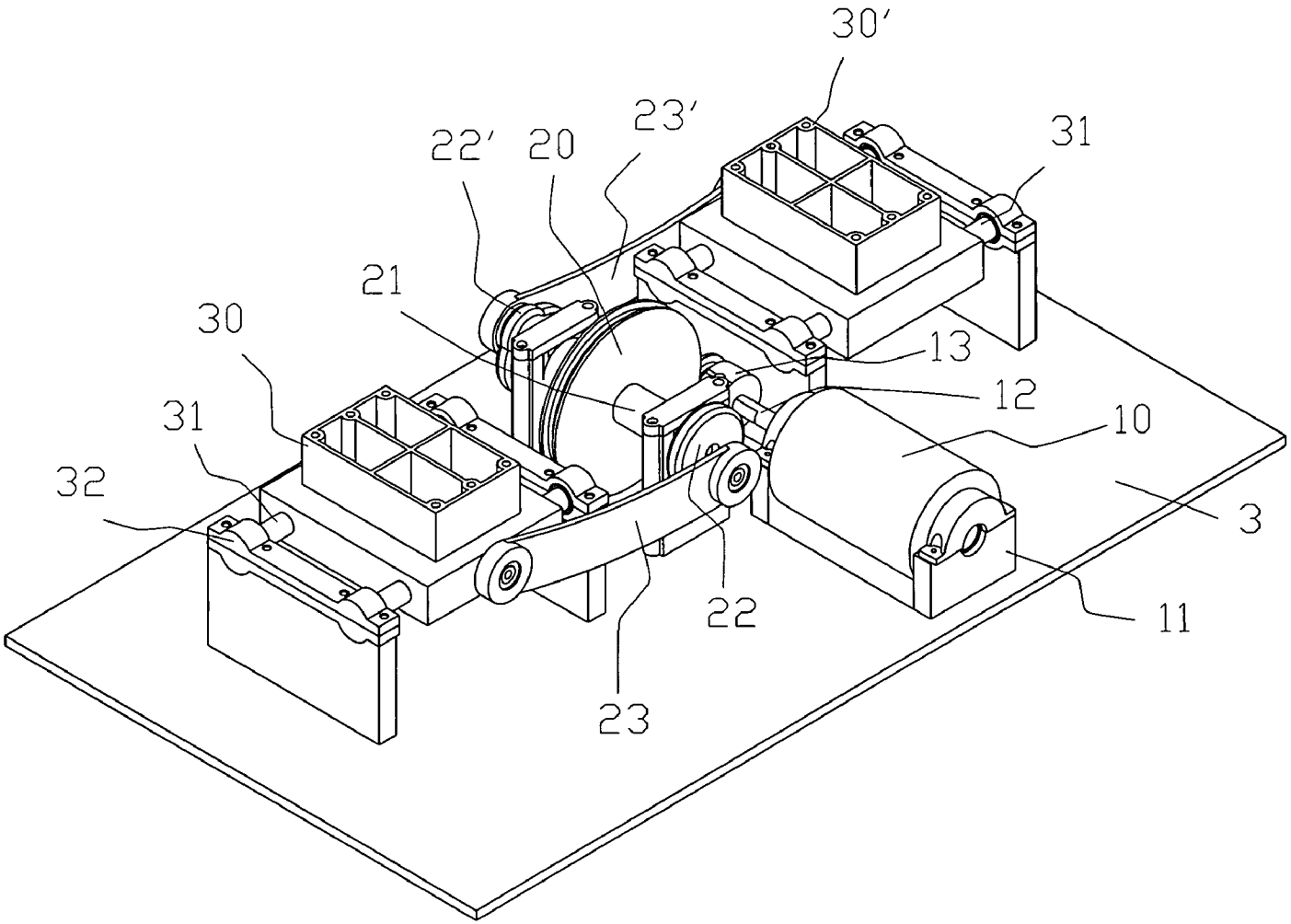
FIG. 2 is a schematic illustration showing an internal structure of the hand/foot muscle exerciser according to the invention.
Figure 3:
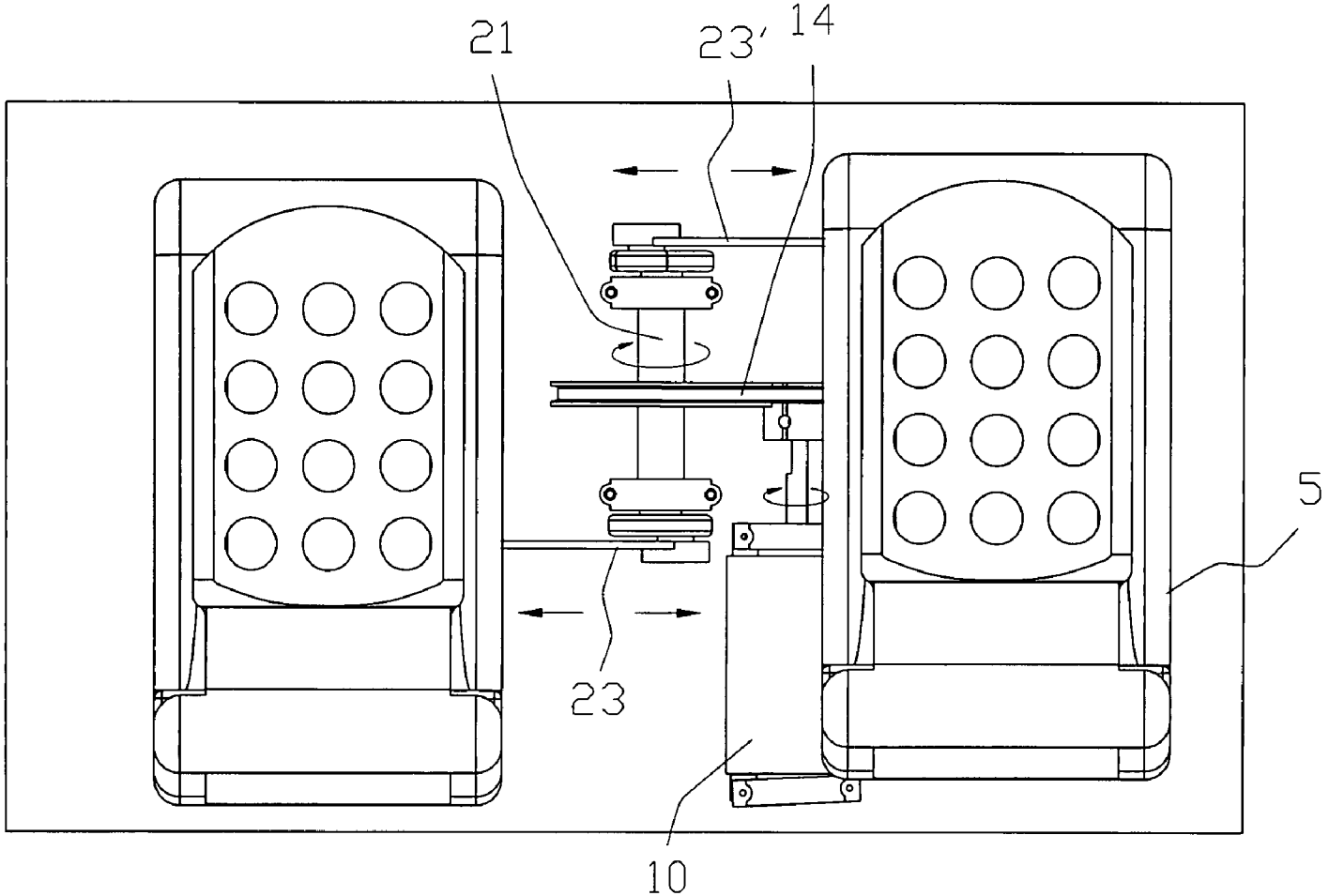
FIG. 3 is a first schematic illustration showing the operation of the hand/foot muscle exerciser according to the invention.
Figure 4:
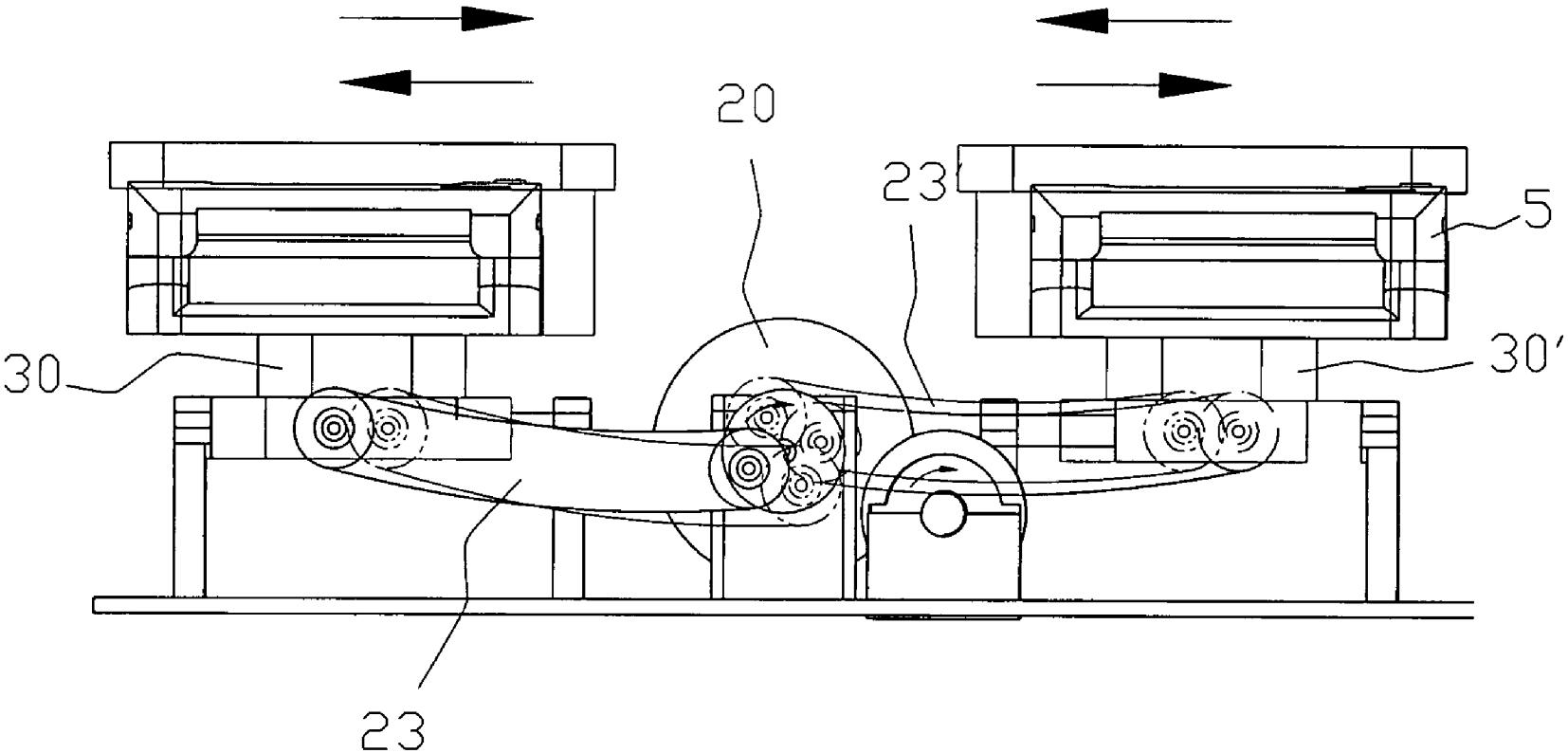
FIG. 4 is a second schematic illustration showing the operation of the hand/foot muscle exerciser according to the invention.

FIG. 2 is a schematic illustration showing the internal structure. FIGS. 3 and 4 are schematic illustration showing operations of the exerciser. As shown in FIGS. 2 to 4, the internal mechanism includes a motor (10), a first pulley (13), a second pulley (20), two transmission wheels (22) and (22'), two transmission links (23) and (23'), two sliding seats (30) and (30'), sliding tracks (31) and fixing members (32). The motor (10) serves as a power source. The motor (10) is fixed to a motor mounting seat (11) of the base (3). The motor (10) has an extended motor shaft (12) on which the first pulley (13) is mounted. The second pulley (20) is connected to the first pulley (13) through a transmission belt (14). The second pulley (20) is mounted to a middle of a pulley shaft (21). The transmission wheels (22) and (22') are mounted on two ends of the pulley shaft (21). The transmission wheels (22) and (22') are respectively connected to the sliding seats (30) and (30') through the transmission links (23) and (23'), which are mounted to the transmission wheels (22) and (22') eccentrically. Two sliding tracks (31) pass a bottom of each of the integrally formed sliding seats (30) and (30'), and are fixed by the fixing members (32) at two sides so as to stabilize the operations of the sliding seats (30) and (30').

The operation of the above-mentioned mechanism will be described in the following. The motor (10) drives the motor shaft (12) and thus the first pulley (13) to rotate. The first pulley (13) drives the second pulley (20) to rotate through the transmission belt (14). The pulley shaft (21) of the second pulley (20) drives the transmission wheels (22) and (22') at two sides to rotate synchronously. Because the transmission links (23) and (23') are respectively connected to the corresponding transmission wheels (22) and (22'), the oppositely leftward and rightward motions can be created such that the connected sliding seats (30) and (30') can slide oppositely on the sliding tracks (31). The two transmission wheels (22) and (22') have opposite designs such that the opposite and repeated sliding operations of the sliding seats (30) and (30') caused when the transmission wheels (22) and (22') rotate cause the open and close operations similar to those of the arm. So, the motion pattern satisfying the human factor engineering can be created.

Figure 5:
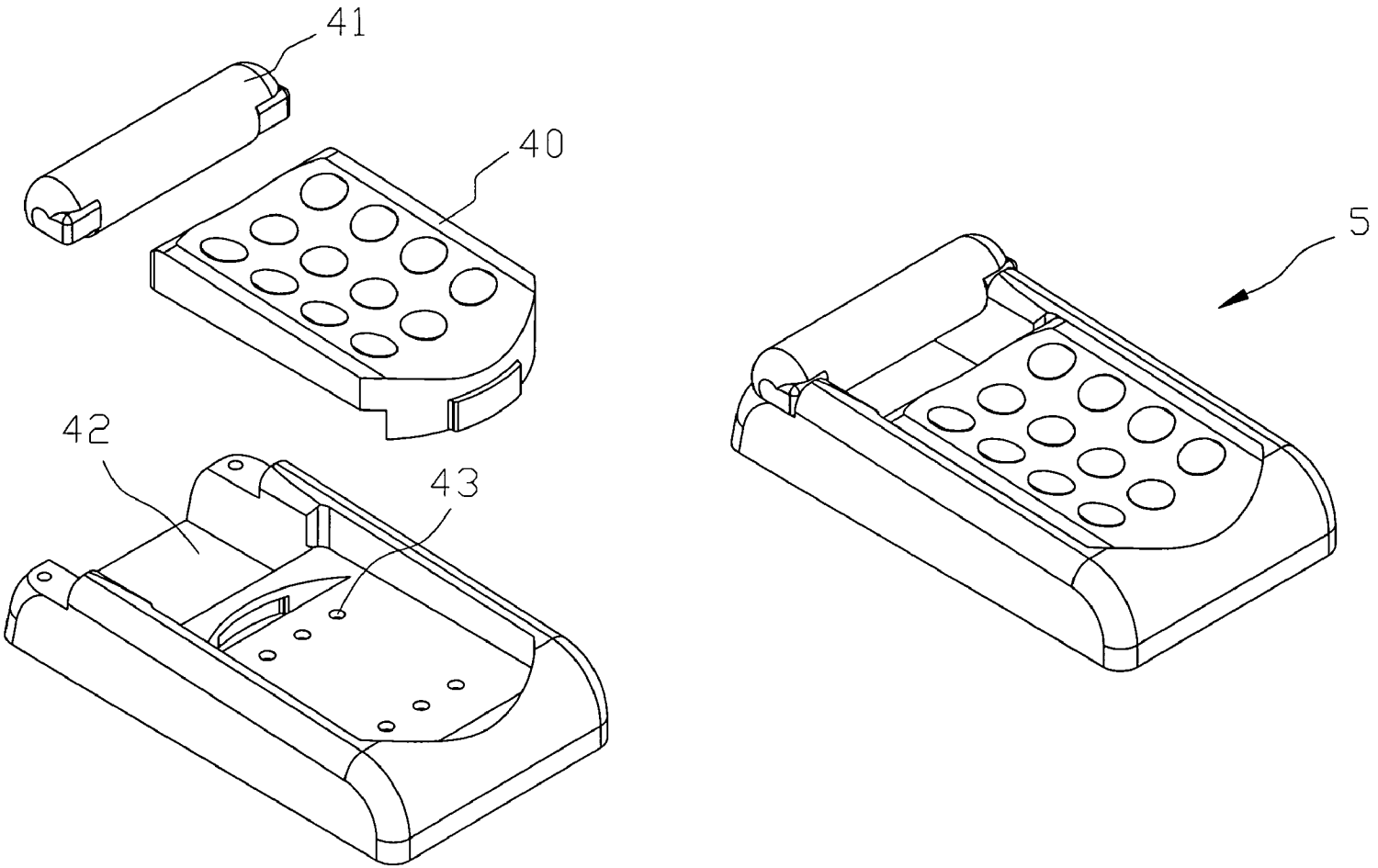
FIG. 5 is a pictorial view showing a massage slider according to the invention.

In addition, the slider (5) of the exerciser (1) of FIG. 1 includes two blocks, as shown in the pictorial view of the slider of FIG. 5. A hollow space is extended to a front end of the slider (5) to form a slot (42). The user's hand can clasp the handle (41) such that the hand can be shaken repeatedly. The rear block under the soft pad (40) is formed with six holes (43) such that the slider (5) can be fixed to the sliding seat (30) or (30'). Furthermore, the soft pad (40) and the soft material are disposed to cover the surface of the slider (5) and the edge of the handle (41) so as to protect the user from danger caused by the sliding of the slider (5) as the user is using this exerciser.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A muscle exerciser, comprising:

an upper cover;

a controller disposed substantially at a middle of the upper cover;

two sliders disposed at two sides of the upper cover;

a base connected to the upper cover; and an internal transmission mechanism disposed between the base and the upper cover, wherein the internal transmission mechanism comprises:

a motor serving as a driving device and having a motor shaft;

a first pulley mounted on the motor shaft;

a second pulley, which is connected to the first pulley through a transmission belt and mounted on a pulley shaft;

two transmission wheels mounted on two ends of the pulley shaft two transmission links respectively connected to the transmission wheels;

two sliding seats respectively connected to the transmission links;

sliding tracks respectively passing through bottoms of the two sliding seats; and fixing members for respectively fixing the sliding tracks, wherein the two transmission wheels and the two transmission links are respectively connected together oppositely such that the motor drives the two transmission wheels to move the two sliding seats oppositely and synchronously and thus to open and close hands/feet.

2. The muscle exerciser according to claim 1, wherein a surface of each of the sliders is covered by a soft material.

3. The muscle exerciser according to claim 1, wherein the sliding seat of each of the sliders is integrally combined with the corresponding sliding track.

* * * * *